US007699313B2

(12) United States Patent
Sakoguchi

(10) Patent No.: US 7,699,313 B2
(45) Date of Patent: Apr. 20, 2010

(54) PAPER SHEET STACKING APPARATUS

(75) Inventor: Yoshitaka Sakoguchi, Yokohama (JP)

(73) Assignee: Kabushiki Kaisha Toshiba, Tokyo (JP)

( * ) Notice: Subject to any disclaimer, the term of this patent is extended or adjusted under 35 U.S.C. 154(b) by 307 days.

(21) Appl. No.: 11/506,914

(22) Filed: Aug. 21, 2006

(65) Prior Publication Data

US 2007/0045941 A1 Mar. 1, 2007

(30) Foreign Application Priority Data

Aug. 26, 2005 (JP) ..... 2005-246145

(51) Int. Cl.
*B65H 29/00* (2006.01)

(52) U.S. Cl. ..... 271/315; 271/306

(58) Field of Classification Search ..... 271/306, 271/315, 187
See application file for complete search history.

(56) References Cited

U.S. PATENT DOCUMENTS

| | | | | |
|---|---|---|---|---|
| 4,595,193 | A * | 6/1986 | Nakamura | 271/187 |
| 4,603,849 | A * | 8/1986 | Nakamura et al. | 271/186 |
| 6,554,273 | B1 * | 4/2003 | Holland-Letz et al. | 271/176 |
| 6,581,929 | B2 | 6/2003 | Hiramitsu | |
| 6,877,740 | B2 * | 4/2005 | Michler et al. | 271/187 |
| 7,219,887 | B2 * | 5/2007 | Michler et al. | 271/187 |
| 2002/0020963 | A1 * | 2/2002 | Steinkogler et al. | 271/315 |
| 2002/0113366 | A1 * | 8/2002 | Watanabe et al. | 271/315 |

FOREIGN PATENT DOCUMENTS

| | | | |
|---|---|---|---|
| EP | 1 167 259 | A2 | 1/2002 |
| EP | 1 219 557 | A2 | 7/2002 |
| JP | 03249056 | A * | 11/1991 |
| JP | 2002-193517 | | 7/2002 |

OTHER PUBLICATIONS

Chinese Office Action dated Jun. 6, 2008 for Appln. No. 200610121278.X.

* cited by examiner

*Primary Examiner*—Kaitlin S Joerger
(74) *Attorney, Agent, or Firm*—Pillsbury Winthrop Shaw Pittman, LLP

(57) ABSTRACT

A paper sheet stacking apparatus comprises a conveying device which has first and second conveying members, wherein take-out ends of the second conveying members are positioned on a more upstream side in a paper sheet conveying direction than a take-out end of the first conveying member, and after a paper sheet is taken out from the second conveying members, the paper sheet is conveyed by only the first conveying member, an impeller which introduces the paper sheet conveyed by only the first conveying member into between vanes thereof to guide the paper sheet in a predetermined direction, and then discharges the paper sheet, and a stack housing which stacks the paper sheets discharged from the impeller.

3 Claims, 4 Drawing Sheets

PAPER SHEET STACKING APPARATUS

CROSS-REFERENCE TO RELATED APPLICATIONS

This application is based upon and claims the benefit of priority from prior Japanese Patent Application No. 2005-246145, filed Aug. 26, 2005, the entire contents of which are incorporated herein by reference.

BACKGROUND OF THE INVENTION

1. Field of the Invention

The present invention relates to a paper sheet stacking apparatus to be applied to, for example, a banknote sorting machine for sorting banknotes (hereinafter, referred to as paper sheets) according their denominations and the like.

2. Description of the Related Art

In a banknote sorting machine, paper sheets are taken in one by one by a take-in unit, conveyed via a conveyance path, inspected at an inspection unit, and, according to the result of the inspection, sorted and stacked in a stacking apparatus.

As a stacking apparatus, there has been known, for example, one disclosed in Jpn. Pat. Appln. KOKAI Publication No. 2002-193517. More specifically, the stacking apparatus, as shown in FIG. 7, includes a first pair of conveying belts 101 that accepts paper sheets supplied along a conveyance path to pinch and feed the paper sheets, and second pairs of conveying belts 102 that are arranged at both the sides of the first pair of conveying belts 101 with a predetermined distance parallel to each other. Further, the stacking apparatus includes an impeller 104 that introduces paper sheets taken out from the first pair of conveying belts 101 and the second pairs of conveying belts 102 into between vanes 103 to guide the paper sheets in a predetermined direction in slowdown and discharges the paper sheets, and a stack housing that stacks the paper sheets discharged from the impeller 104.

The first pair of conveying belts 101 is configured by an upper belt 101*a* and a lower belt 101*b*, and the second pair of conveying belts 102 is configured by an upper belt 102*a* and a lower belt 102*b*. The upper belts 101*a*, 102*a* are stretched over rollers 105, 106 and released upward.

However, in the prior art, a paper sheet P has been conveyed to a passing area to the impeller 104 by three belts, i.e., the upper belt 101*a* of the first pair of conveying belts 101 and the upper belts 102*a*, 102*a* of the second pairs of conveying belts 102. Consequently, a force of binding the paper sheet P by the upper belts 101*a*, 102*a*, 102*a* is strong. If the paper sheet P is fed, for example, in its skewed state, the paper sheet gains entry into the vanes 103 as it is in the skewed state.

For this reason, as shown in FIG. 8, the paper sheets cannot gain entry into the vanes 103 of a same phase of impellers 104*a*, 104*b* that are positioned in the front side and the back side, respectively, but the paper sheets get alternately into vanes 103 of different phases, which causes a stack failure.

Further, even when the paper sheet P is conveyed in a non-skewed state, in particular, in the case where the speed of conveying the paper sheet P is increased in order to increase the processing capacity, the impact at the moment when the paper sheet P collides against the vanes 103 becomes large, and the paper sheet P becomes buckled as shown in FIG. 9, which causes a stack failure.

The present invention has been made in consideration of the above circumstances, and accordingly, an object of the present invention is to provide a paper sheet stacking apparatus in which, if a paper sheet entering an impeller is skewed, the skewed state can be corrected, and the impact when the paper sheet enters the impeller can be buffered.

BRIEF SUMMARY OF THE INVENTION

A paper sheet stacking apparatus according to one aspect of the present invention comprises:

a conveying device which has a first conveying member, and second conveying members arranged at both the sides of the first conveying member with a predetermined distance parallel to each other, the conveying device conveying paper sheets by the first and second conveying members, wherein take-out ends of the second conveying members are positioned on a more upstream side in a paper sheet conveying direction than a take-out end of the first conveying member, and after the paper sheet is taken out from the second conveying members, the paper sheet is conveyed by only the first conveying member;

an impeller which introduces the paper sheet conveyed by only the first conveying member into between vanes thereof to guide the paper sheet in a predetermined direction, and then discharges the paper sheet; and a stack housing which stacks the paper sheets discharged from the impeller.

A paper sheet stacking apparatus according to another aspect of the present invention comprises:

a conveying device which has a first pair of conveying belts, and second pairs of conveying belts arranged at both the sides of the first pair of conveying belts with a predetermined distance parallel to each other, the conveying device conveying paper sheets by the first and second pairs of conveying belts, wherein take-out ends of the second pairs of conveying belts are positioned on a more upstream side in a paper sheet conveying direction than a take-out end of the first pair of conveying belts and the end portion of one belt of the first pair of conveying belts is positioned on a more upstream side in the paper sheet conveying direction than the end portion of the other belt, and after the paper sheet is taken out from the second pairs of conveying belts, the paper sheet is conveyed by only the other belt of the first pair of conveying belts;

an impeller which introduces the paper sheet conveyed by only the other belt of the first pair of conveying belts into between vanes thereof to guide the paper sheet in a predetermined direction, and then discharges the paper sheet; and a stacking unit which stacks the paper sheets discharged from the impeller.

According to one aspect of the present invention, when paper sheets are skewed, its skewed state can be corrected while the paper sheets can be made to gain entry into vanes of a same phase of neighboring impellers, and further, even when paper sheets enter at a high speed, buckling thereof can be prevented, and stable stacking can be performed.

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out hereinafter.

BRIEF DESCRIPTION OF THE SEVERAL VIEWS OF THE DRAWING

The accompanying drawings, which are incorporated in and constitute a part of the specification, illustrate embodiments of the invention, and together with the general description given above and the detailed description of the embodiments given below, serve to explain the principles of the invention.

DETAILED DESCRIPTION OF THE INVENTION

Now, an embodiment of the present invention will be described in more details with reference to the accompanying drawings.

Figure 1:
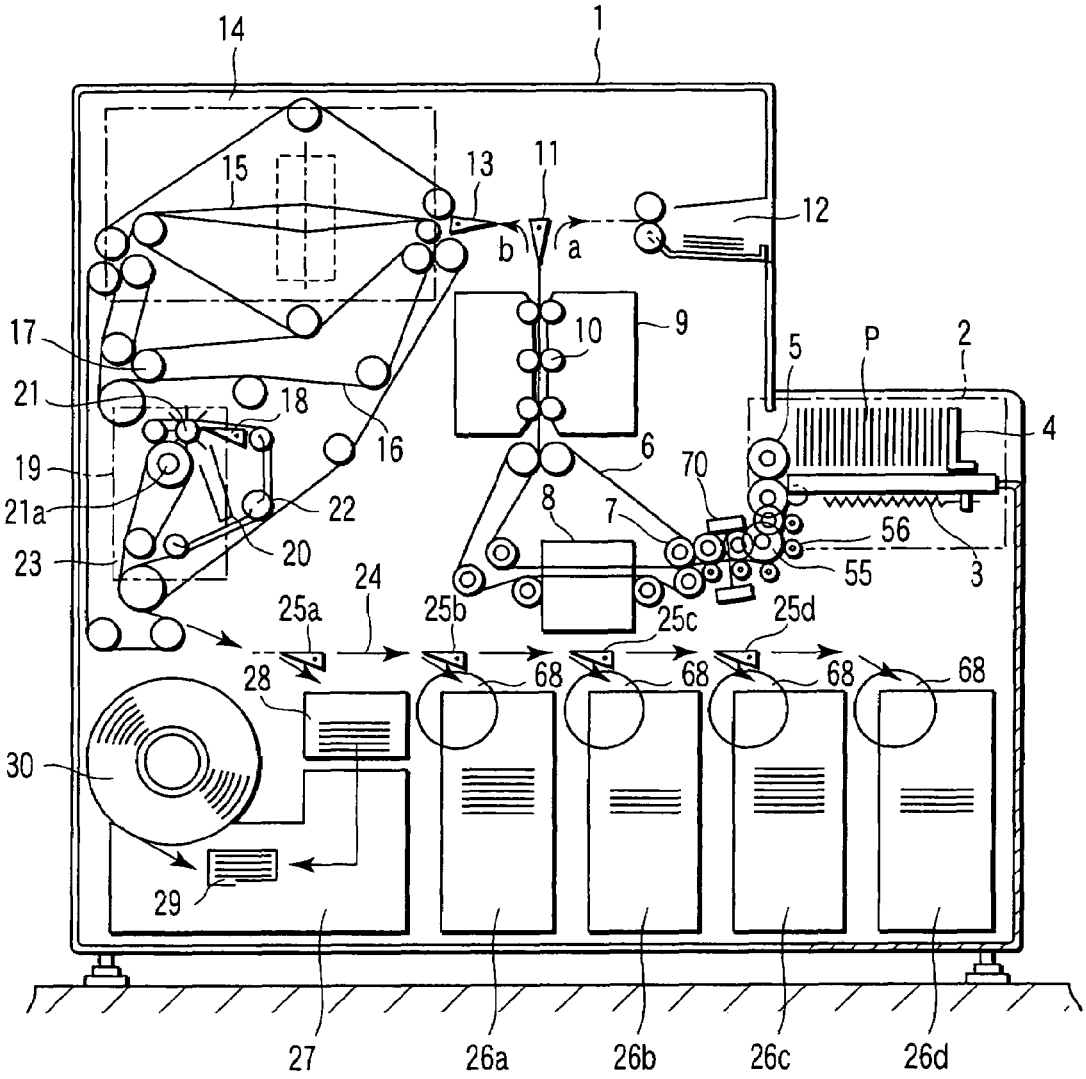
FIG. 1 is an entire structural view showing a paper sheet processing apparatus according to one embodiment of the present invention.

FIG. 1 is a schematic structural view showing a paper sheet sorting apparatus serving as an paper sheet processing apparatus which is an embodiment of the present invention.

Reference numeral 1 in FIG. 1 denotes an apparatus main body, and a feeding unit 2 is arranged at substantially the center portion of one side of the apparatus main body 1. In the feeding unit 2, plural paper sheets P such as banknotes are contained in the upright position. The feeding unit 2 is provided with a backup plate 4 that is biased by a spring 3, and the paper sheets P are delivered by the backup plate 4. A feeding roller 5 is arranged in the direction of delivering the paper sheet P. Under the feeding roller 5, a rubber roller 55 and a roller 56 that contacts the rubber roller 55 are arranged. The roller 56 is biased by a spring material to clamp and convey the paper sheet together by the roller 55.

Further, in the direction of feeding the paper sheet P, a transmissive optical sensor array 70 for detecting the shift amount and the skew amount of the taken-out paper sheet is arranged.

The paper sheet passes through the optical sensor array 70, and is then sent to a clamp type conveying mechanism 6 configured by a pair of belts and a roller 7. A posture correction apparatus 8 for automatically correcting the shift amount and the skew amount of the taken-out paper sheet P is arranged in the conveying mechanism 6.

A determining unit 9 is arranged above the conveying mechanism 6. The determining unit 9 reads various kinds of information from the surface of the paper sheet P conveyed by a pair of rollers 10, and performs logical operation to the information to be compared with information serving as a reference. Consequently, the determining unit determines the presence or absence of dust or damage, denominations (money amounts) of paper sheets, and further, their four directions of head and tail and front side and back side of the paper sheets.

A first gate unit 11 is arranged above the determining unit 9, and the first gate unit 11 changes the direction of conveying the paper sheet P to the arrow "a" direction or the arrow b direction. More specifically, the direction of conveying the paper sheets that are not determined as authentic bills by the determining unit 9 (for example, two paper sheets taken together at one time, paper sheets that are excessively skewed, and the like) is changed to the arrow "a" direction, so that the paper sheets are guided to a reject box 12.

On the other hand, when the determining unit 9 determines that a paper sheet is an authentic bill and the front side thereof is upward, the conveying direction is changed to the arrow b direction. In the arrow b direction, a second gate unit 13 is arranged, and the second gate unit 13 changes the direction of conveying the paper sheet P to first and second directions. A first route is arranged in the first direction. A mirror inverting path 14 as inverting means is arranged in the first route, and a twist belt 15 for inverting the paper sheet horizontally by 180 degrees is arranged in the mirror inverting path 14. A second route is arranged in the second direction. In the second route, a normal conveying belt 16 is arranged, and the paper sheet is conveyed while the posture thereof is maintained as it is. The first and second routes flow together at an interflow unit 17. The route lengths of the first and second routes to the interflow unit 17 are made equal to each other so that the intervals of paper sheets after the interflow should not become out of alignment.

A third gate unit 18 is arranged below the interflow unit 17, and the third gate unit 18 changes the direction of conveying the paper sheet to third and fourth directions. A third route is arranged in the third direction, and a fourth route is arranged in the fourth direction. In the third route, a switch back path 19 is arranged. The rear end of the paper sheet guided to an inversion box 20 of the switch back path 19 is pushed to an inversion roller 21*a* by a tap wheel 21, and consequently, the head and tail thereof are inverted and the paper sheet is conveyed. A normal conveying belt 22 is arranged in the fourth route, and the paper sheet is conveyed by the conveying belt 22 while the posture thereof is maintained as it is.

The third and fourth routes are flown together at an interflow unit 23. The route lengths of the third and fourth routes to the interflow unit 23 are made equal to each other so that the intervals of paper sheets delivered from the interflow unit 23 should not become out of alignment.

In the paper sheet delivering direction of the interflow unit 23, a horizontal conveying path 24 is arranged, and the number of gate units 25*a* to 25*d* that is less by one than the number of portions to be divided are arranged in the horizontal conveying path 24.

Stacking apparatuses 28, 26*a* to 26*d* for respective denominations are arranged below the gate units 25*a* to 25*d*. In the stacking apparatuses 28, 26*a* to 26*d*, paper sheets are piled at level and stacked.

Reference numeral 27 denotes a 100-note banding apparatus. The 100-note banding apparatus transfers 100 paper sheets stacked in the stacking apparatus 28 from the stacking apparatus 28 to a banding unit 29, and binds the 100 paper sheets with a strip band 30 into a paper sheet bundle.

Figure 2:
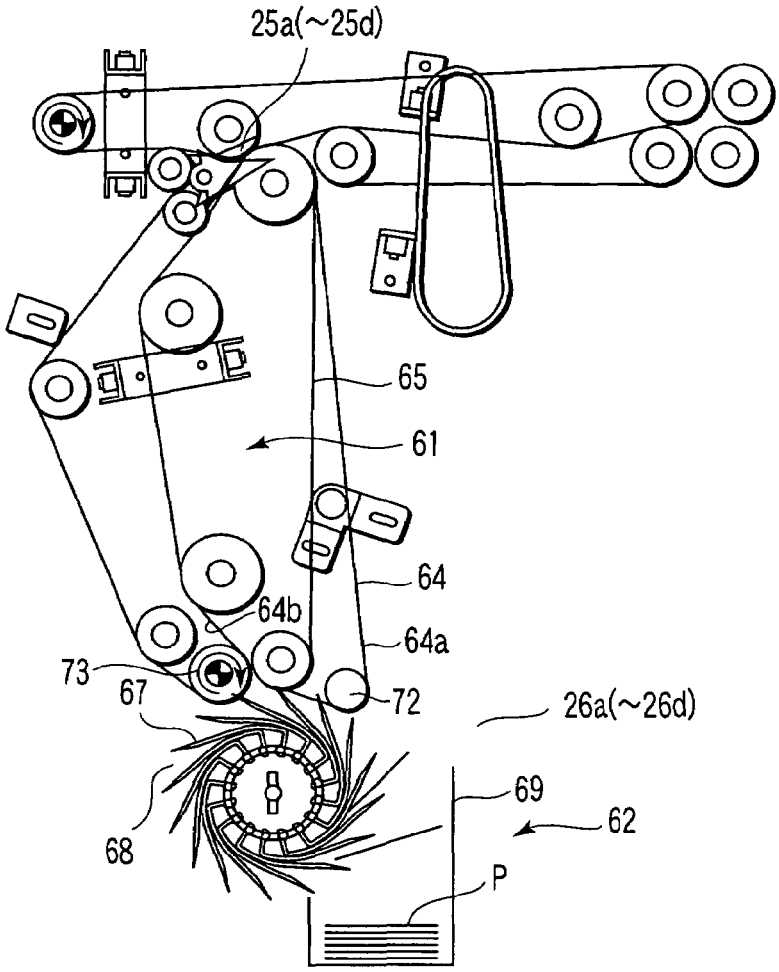
FIG. 2 is a structural view showing a stacking apparatus in the paper sheet processing apparatus shown in FIG. 1.

FIG. 2 is a structural view showing the stacking apparatuses 26*a* to 26*d*.

Each of the stacking apparatuses 26*a* to 26*d* is configured by a conveying device 61 for conveying paper sheets, and a stacking unit 62 for stacking the paper sheets conveyed by the conveying device 61.

The stacking unit 62 is configured to have a pair of impellers 68 for guiding paper sheets P into between vanes 67 to decelerate the paper sheets and guiding them in a predetermined direction, a scrape-out member (not shown) for scraping out the paper sheets guided by the impellers 68 from the impellers 68, and a stack housing 69 for stacking the paper sheets scraped out by the scrape-out member. The pair of impellers 68 is arranged so as to be adjacent to each other with a predetermined distance in a direction perpendicular to the direction of conveying the paper sheets.

Figure 3:
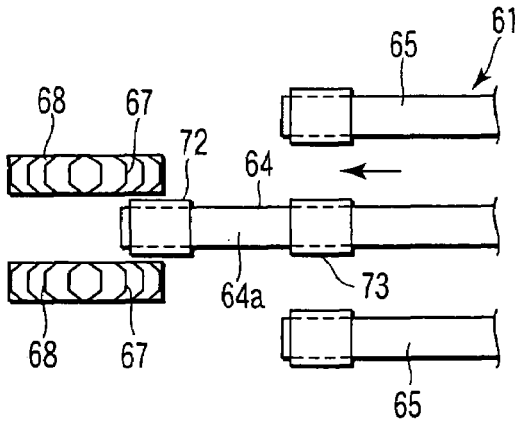
FIG. 3 is a plan view showing the arrangement of a conveying device and impellers in the stacking apparatus shown in FIG. 2.

The conveying device 61 is, as shown in FIG. 3, constituted of a first pair of conveying belts 64 serving as a first conveying member, the conveying belts 64 being arranged around the center of the conveying path along the paper sheet conveying direction, and second pairs of conveying belts 65 serving as a second conveying member, the conveying belts 65 being arranged in parallel to each other with a predetermined distance at both the sides of the first pair of conveying belts 64. A take-out end of the second pair of conveying belts 65 is positioned on a more upstream side in the paper sheet conveying direction by a predetermined distance than a take-out end of the first pair of conveying belt 64.

Figure 4:
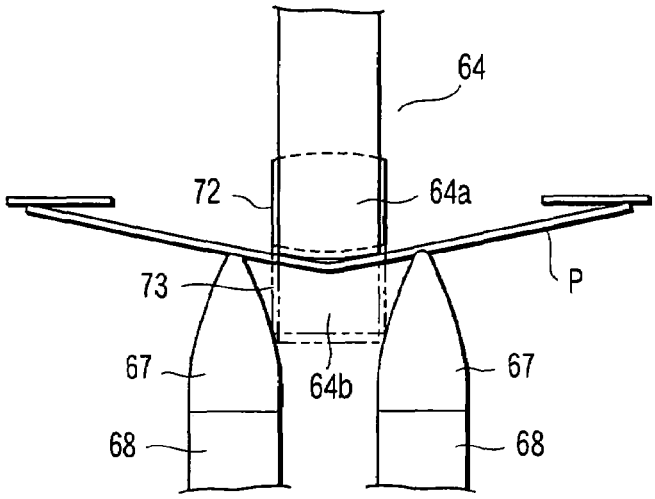
FIG. 4 is a front view showing the arrangement of the conveying device and impellers in the stacking apparatus shown in FIG. 2.

The first pair of conveying belts 64 is, as shown in FIG. 4, constituted of an upper belt 64*a*, and a lower belt 64*b* that is overlapped on the upper belt 64*a*. The upper belt 64*a* is stretched over a roller 72 and released upward, and the lower belt 64*b* is stretched over a roller 73. The end portion of the lower belt 64*b* of the first pair of conveying belts 64 is positioned on a more upstream side in the paper sheet conveying direction by a predetermined distance than the end portion of the upper belt 64*a*, and the end portion of the upper belt 64*a* is positioned between vane end portions of the pair of impellers 68. Consequently, the paper sheets pinched and conveyed by the first pair of conveying belts 64 and the second pairs of conveying belts 65 are conveyed from the second pairs of conveying belts 65, in other words, at a passing area of the paper sheets to the impellers 68, the paper sheets are conveyed by only the upper belt 64*a* of the first pair of conveying belts 64.

Next, the operation for stacking the paper sheets will be explained.

Figure 5:
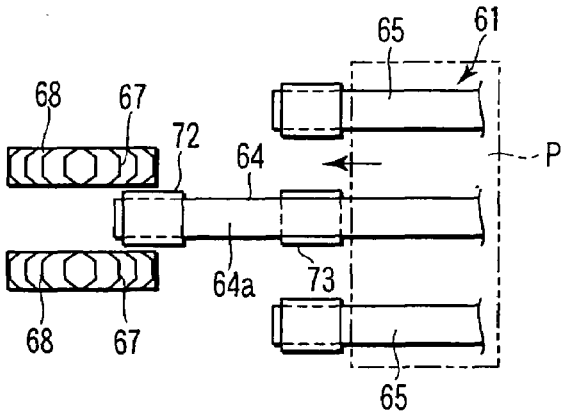
FIG. 5 is a view showing a paper sheet to be conveyed by the conveying device shown in FIG. 3.
Figure 6:
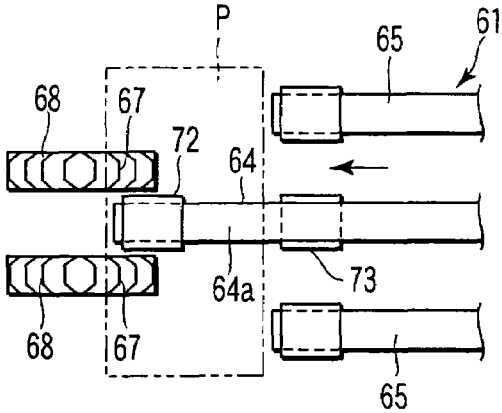
FIG. 6 is a view showing a paper sheet conveyed to a passing area to the impellers by the conveying device shown in FIG. 3.
Figure 7:
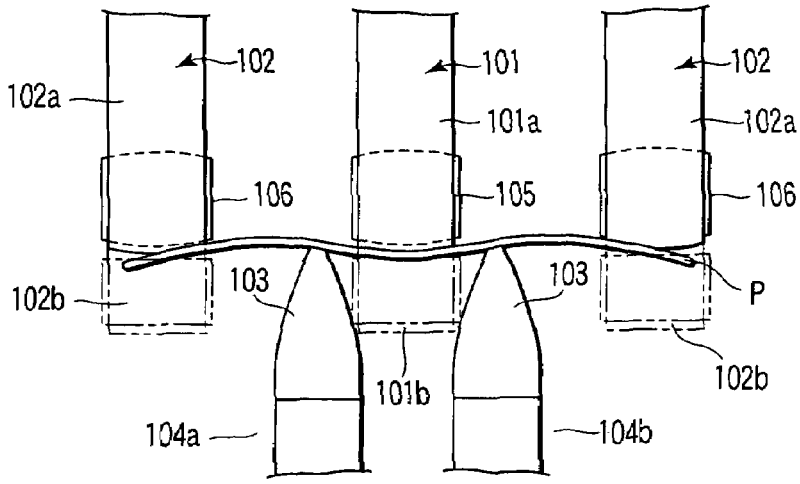
FIG. 7 is a front view showing the arrangement of a conveying device and impellers in a conventional stacking apparatus.
Figure 8:
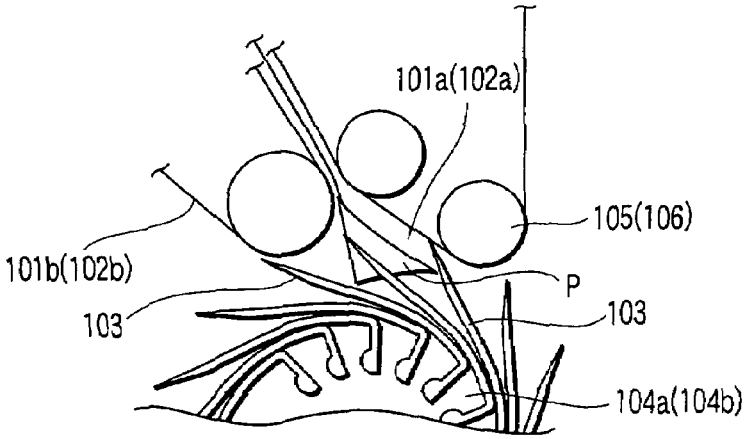
FIG. 8 is a view showing a paper sheet being guided into vanes of different phases of neighboring impellers in the conventional stacking apparatus.
Figure 9:
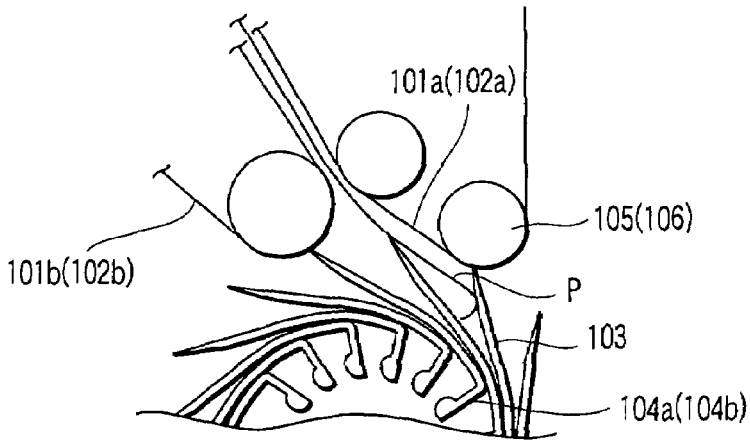
FIG. 9 is a view showing a paper sheet being guided in its skewed state into vanes of impellers in the conventional stacking apparatus.

When the paper sheet P to be conveyed by the conveying device 61 as shown in FIG. 5 reaches the passing area to the impellers 68 as shown in FIG. 6, the paper sheet P is taken out from the second pairs of conveying belts 65, 65 and the binding of both the sides thereof is released. After the release of the binding, the paper sheet P is conveyed by only the upper belt 64*a* of the first pair of conveying belts 64, and guided into between the vanes 67 of the impellers 68. The guided paper sheet P is guided in a predetermined direction by the rotation of the impellers 68, and then scraped out by the scrape-out member (not shown) to be stacked in the stack housing 69.

As described above, according to the present embodiment, the paper sheets are conveyed by only the upper belt 64*a* of the first pair of conveying belts 64 at the passing area of the paper sheets to the impellers 68, and the binding of both the sides of the paper sheets by the second pairs of conveying belts 65, 65 is released. As a consequence, even if the paper sheet P is skewed, the paper sheet is guided to and contacts the vanes 67 of the impellers 68, whereby the skewed state is corrected and the paper sheet is taken in the impellers 68. Accordingly, preferable stacking of paper sheets can be performed.

Further, even if the paper sheet is not skewed, the impact becomes large and there is a fear that the paper sheet becomes buckled when it is guided to vanes of the impellers at a high speed. However, as described previously, since the binding by means of the second pairs of conveying belts 65, 65 is released, the paper sheet moderately slips and decelerates, and the impact at rushing in becomes small. Accordingly, it is possible to prevent the paper sheet from being skewed, and preferable stacking can be performed.

In the above embodiment, the paper sheets are conveyed by only the upper belt 64*a* of the first pair of conveying belts 64 at the passing area of the paper sheets to the impellers 68, but the present invention is not limited thereto. The end portion of the lower belt 64*b* may be extended to the end portion of the upper belt 64*a*, and the paper sheets P may be pinched and conveyed by the upper belt 64*a* and the lower belt 64*b* even at the passing area.

Additional advantages and modifications will readily occur to those skilled in the art. Therefore, the invention in its broader aspects is not limited to the specific details and representative embodiments shown and described herein. Accordingly, various modifications may be made without departing from the spirit or scope of the general inventive concept as defined by the appended claims and their equivalents.

What is claimed is:

1. A paper sheet stacking apparatus comprising:

a conveying device having a first pair of conveying belts including an upper belt and a lower belt and second pairs of conveying belts each including an upper belt and a lower belt, the second pairs of conveying belts being arranged at both the sides of the first pair of conveying belts in parallel with a predetermined distance between them, the conveying device conveying paper sheets along a widthwise direction thereof by the first and second pairs of conveying belts;

an impeller configured to introduce the paper sheets conveyed by the conveying device; and a stacking unit configured to stack the paper sheets discharged from the impeller, wherein only the upper belt of the first pair of conveying belts is extended from a take-out end of the conveying device to the impeller, and the extended upper belt conveys and guides the paper sheets to the impeller.

2. The paper sheet stacking apparatus according to claim 1, wherein a plurality of impellers, each having the same configuration as the impeller, are arranged so as to oppose each other with a predetermined distance in a direction perpendicular to the paper sheet conveying direction.

3. The paper sheet stacking apparatus according to claim 2, wherein the end portion of the upper belt of the first pair of conveying belts is positioned between the end portions of the vanes of the impellers arranged to oppose each other with a predetermined distance.

* * * * *